United States Patent [19]

Hidasi et al.

[11] Patent Number: 4,629,405

[45] Date of Patent: Dec. 16, 1986

[54] GEAR PUMP HAVING AN AUTOMATIC LUBRICATOR

[75] Inventors: Geza Hidasi, Bobingen; Karl Zill, Gersthofen, both of Fed. Rep. of Germany

[73] Assignee: Hoechst Aktiengesellschaft, Fed. Rep. of Germany

[21] Appl. No.: 175,646

[22] Filed: Aug. 6, 1980

[30] Foreign Application Priority Data

Aug. 10, 1979 [DE] Fed. Rep. of Germany ..... 2932464

[51] Int. Cl.[4] ..... F04C 2/18; F04C 15/00; F16N 13/20; F16C 33/10

[52] U.S. Cl. ..... 418/102; 418/206; 184/31; 384/378; 384/398

[58] Field of Search ..... 418/88, 94, 102, 202, 418/205, 206; 184/6.28, 31; 308/93, 107, 122; 384/378, 398

[56] References Cited

U.S. PATENT DOCUMENTS

| | | | |
|---|---|---|---|
| 1,103,053 | 7/1914 | Kiefer | 418/202 |
| 1,132,701 | 3/1915 | Block | 308/122 |
| 2,249,059 | 7/1941 | Stenger | 184/31 |
| 2,432,576 | 12/1947 | Koffer | 418/102 |
| 2,986,096 | 5/1961 | Booth et al. | 418/102 |
| 2,993,450 | 7/1961 | Weigert | 418/102 |
| 3,306,225 | 2/1967 | Smith | 418/102 |

FOREIGN PATENT DOCUMENTS

| | | | |
|---|---|---|---|
| 586120 | 10/1933 | Fed. Rep. of Germany | 418/94 |
| 867951 | 2/1953 | Fed. Rep. of Germany | 418/206 |
| 2110940 | 10/1971 | Fed. Rep. of Germany | 418/94 |
| 322778 | 12/1929 | United Kingdom | 418/102 |

*Primary Examiner*—John J. Vrablik
*Attorney, Agent, or Firm*—Connolly and Hutz

[57] ABSTRACT

In gear pumps having an automatic lubricator, channels are provided for the delivery to and the discharge from the pump bearings, of lubricant, which consists of and is withdrawn from the medium to be conveyed. The conveying means for conveying the lubricant through the channels are mounted in the shafts of the gear pump. The channels can connect the suction side or the delivery side or the suction and delivery sides of the pump to the pump bearing.

6 Claims, 5 Drawing Figures

GEAR PUMP HAVING AN AUTOMATIC LUBRICATOR

The present invention relates to a gear pump having an automatic lubricator in which the lubrication channels connect the bearings of the gear pump to the discharge port on the delivery side of the pump.

Gear pumps are frequently used for the conveyance and metering of viscous media, such as, for example, melts of high molecular weight polymers. A particular problem arises in this connection with the lubrication of the bearings. In this case conventional lubricants, such as oils, greases or graphite, cannot be used, as these would contaminate the medium to be conveyed; lubrication must be effected by the actual medium delivered.

With known gear pumps this lubrication of the bearings by the delivered medium is effected in such a way that a part-stream of the delivered medium is conveyed from the delivery side of the pump to the bearings via lubrication channels and back to the suction side. A gear pump of this type is known from Japanese Published Application No. 75/010,402. This method of lubrication means that an internal leakage in the pump is caused deliberately, thereby reducing pump efficiency by the amount of leakage thus produced.

The dimensioning of these lubrication channels is determined by two fundamental requirements. Firstly, it must be ensured that melt flows continuously through the lubrication channels. Obstruction of the flow of melt, occurring in the usual way, gives rise to relatively long retention times in the lubrication channel system, thereby encouraging thermal decomposition. The decomposition products which are deposited cause further friction losses for the flow until, as a result of this self-increasing effect, the lubrication channels are totally blocked, which usually results in jamming of the bearings concerned. This blockage of the lubrication channels can also be initiated by solid particles, such as matting substances or pigments. Larger lubrication channels would prevent this blockage, but these give rise to an inadmissible increase in the leakage rate, and this proves to be particularly troublesome with gear pumps having a high discharge capacity and operating under high pressure.

It is therefore the object of the present invention to provide a gear pump having an automatic lubricator in which it is possible to use sufficiently large lubrication channels and to prevent a rate of leakage caused by such lubrication channels in the gear pump.

The object is achieved in that delivery means for conveying the lubricants through the channels are mounted in the shafts of the pump.

These conveying means are mounted preferably coaxially in shafts of the gear pump. The conveying means can be in the form of gear pumps or screw conveyors mounted in the shafts. The conveying means are mounted in such a way that they can move relative to the shafts of the gear pump. The invention is explained in more detail below with the aid of the drawings which merely show examples.

The conveying means receive the lubricant, namely a part-stream of the melt, which flows from the discharge side of the gear pump into the bearing bushes via one or a plurality of lubrication channels, and convey it through bores in the shafts in the direction of the oppositely-mounted bearing bushes. The melt flows back to the discharge side of the pump through lubrication channels in these bearing bushes. The conveying means only need to build up sufficient pressure to convey the lubricant through the lubrication channels. In the device according to the invention, large lubrication channels, which do not become blocked by deposits, can be selected for the part-stream of melt for lubricating the bearings. The forced-feed method of delivery also prevents the melt from being retained too long in the lubrication channels, which could give rise to thermal decomposition of the melt.

Figure 1:
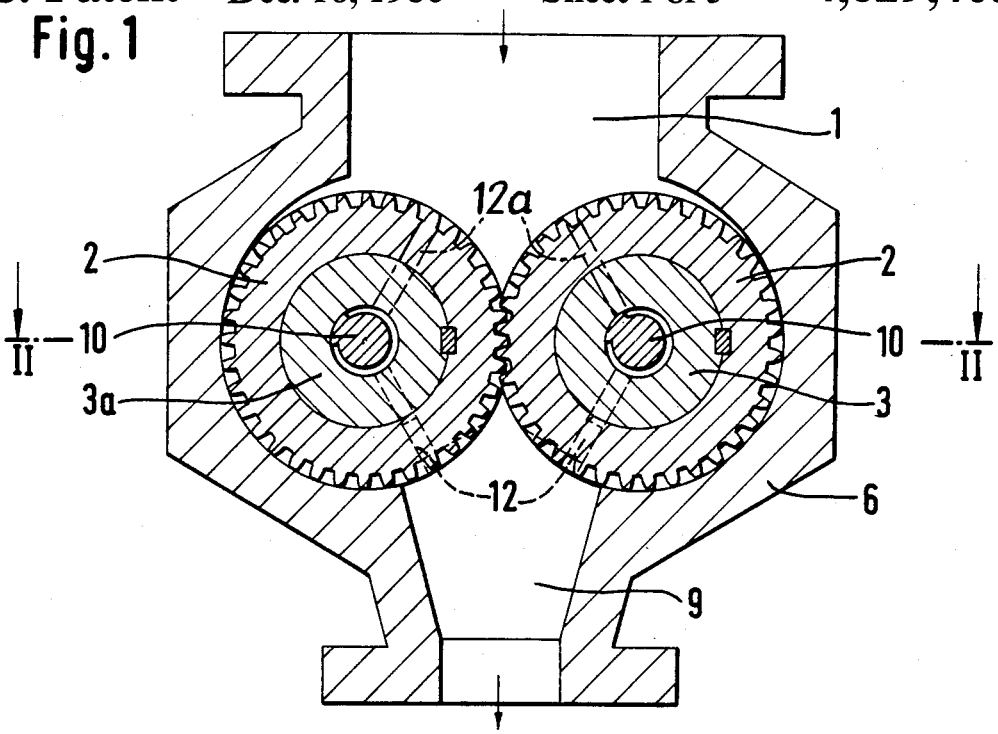
FIG. 1 shows, in section, the gear pump according to the invention, having a screw conveyor as a conveying means for the lubricants for the forced-feed lubrication of the bearing bushes of the pump.
Figure 2:
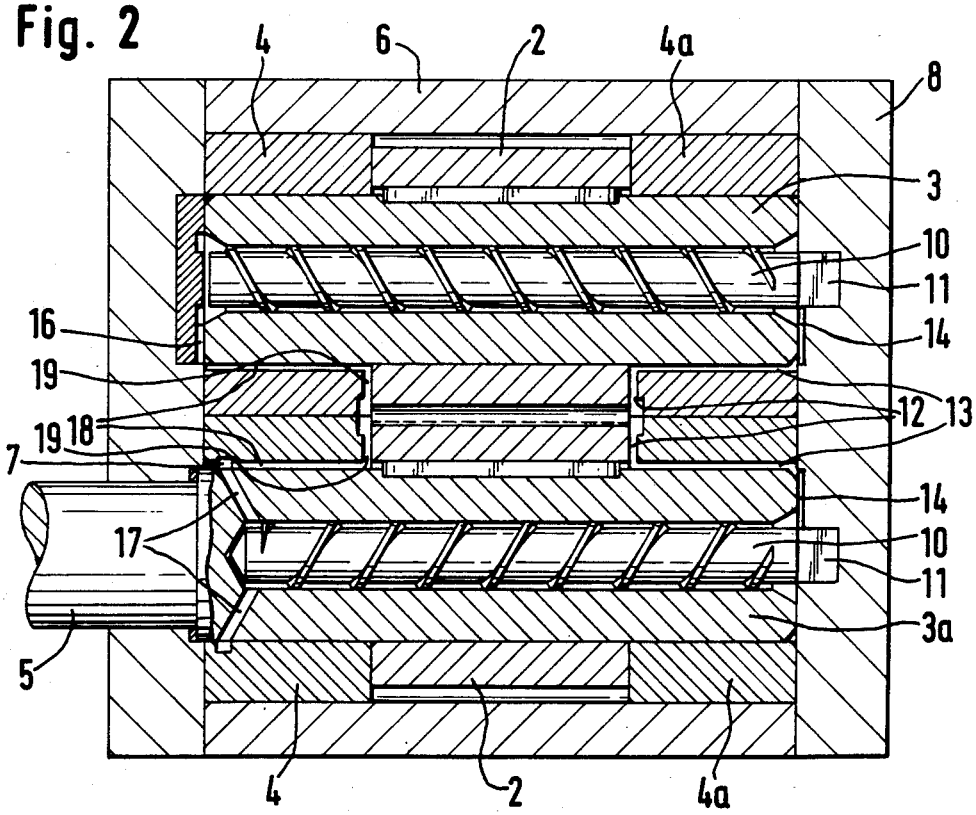
FIG. 2 shows the section II—II of FIG. 1.

In the gear pump according to FIG. 1, the medium to be conveyed flows into the pump via the suction side 1 and is conveyed to the delivery side 9 by two mutually meshing gears 2 rotating in opposite directions. The gear shafts 3, 3*a* are mounted in bushes 4, 4*a* which seal the gears on their front side. A shaft journal 5 extends, through sealing devices (not shown) which are known per se, out of the otherwise sealed pump casing 6 towards the driving unit (not shown). Mounted in a concentric bore in each shaft is a screw conveyor 10 which is connected to the front side 8 of the casing by means of a pin 11 and is secured to prevent rotation. If the pump is then set into operation, the shaft rotates about the stationary screw and the system operates like an extruder. The part-stream of the medium which is used for lubrication then flows from the delivery side 9 through the channels 12 in the bearing bushes 4*a* on the front side, through the channels 13 (lubrication grooves for the bearing bushes 4*a*) and through the channels 14 in the front side 8 of the casing to the suction side of the screw conveyor 10. The medium is conveyed by the screws to each oppositely-lying bearing and flows through the channel 16 or through the bore 17 and the annular channel 7, and through the channels 18 (lubrication grooves for the bearing bushes 4) and the channels 19 to the delivery side 9 of the pump.

Figure 3:
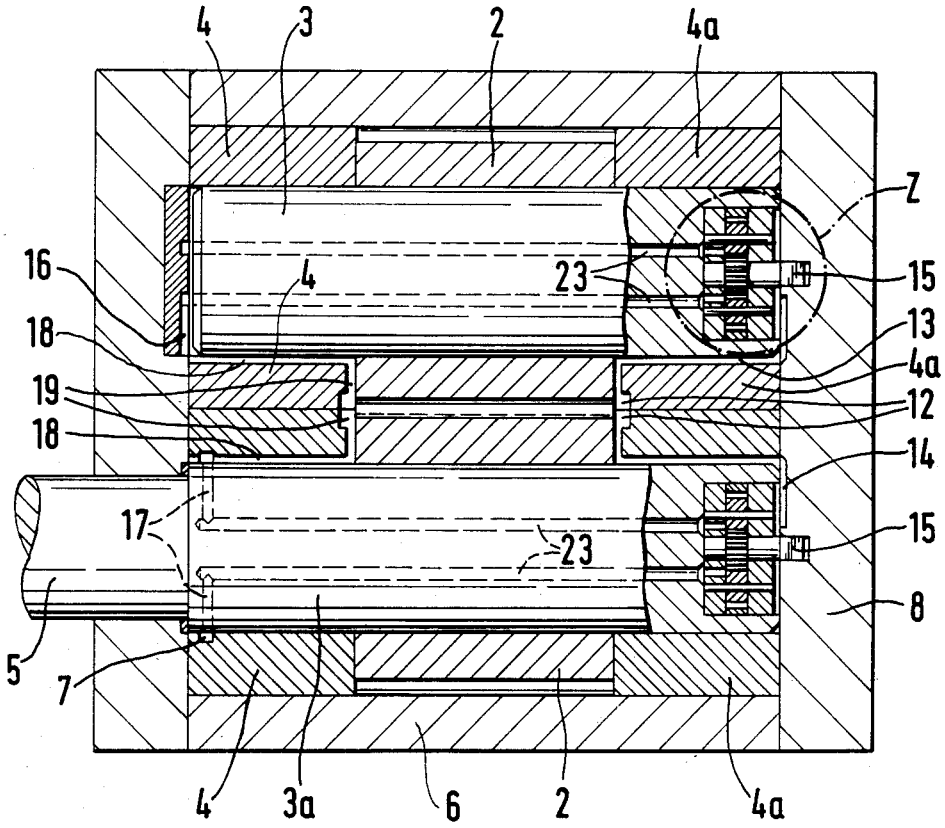
FIG. 3 shows the use of a gear pump as a lubricant delivery means.
Figure 4:
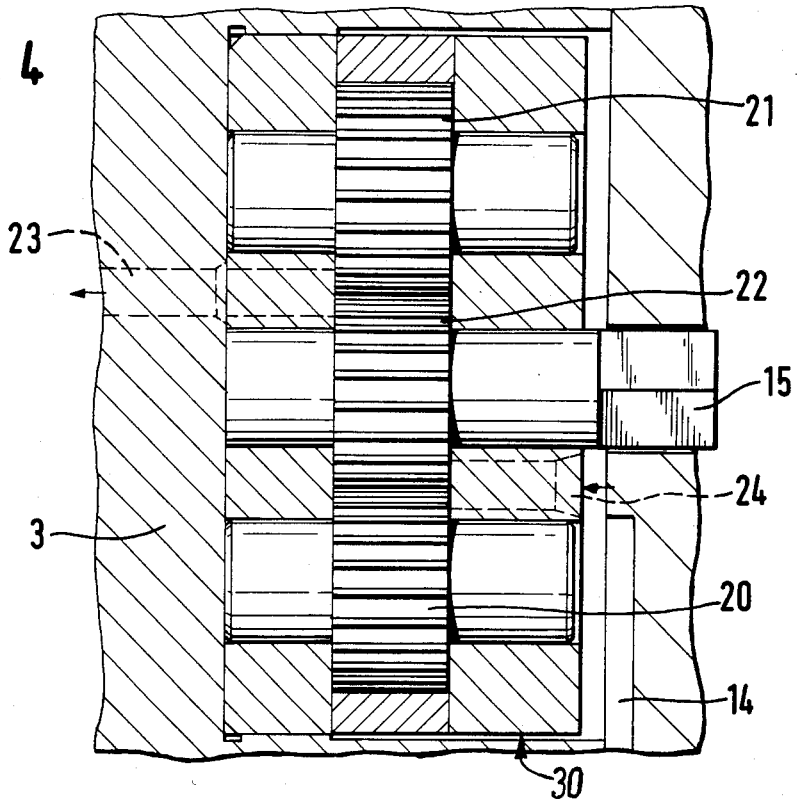
FIG. 4 shows the detail "Z" of FIG. 3.
Figure 5:
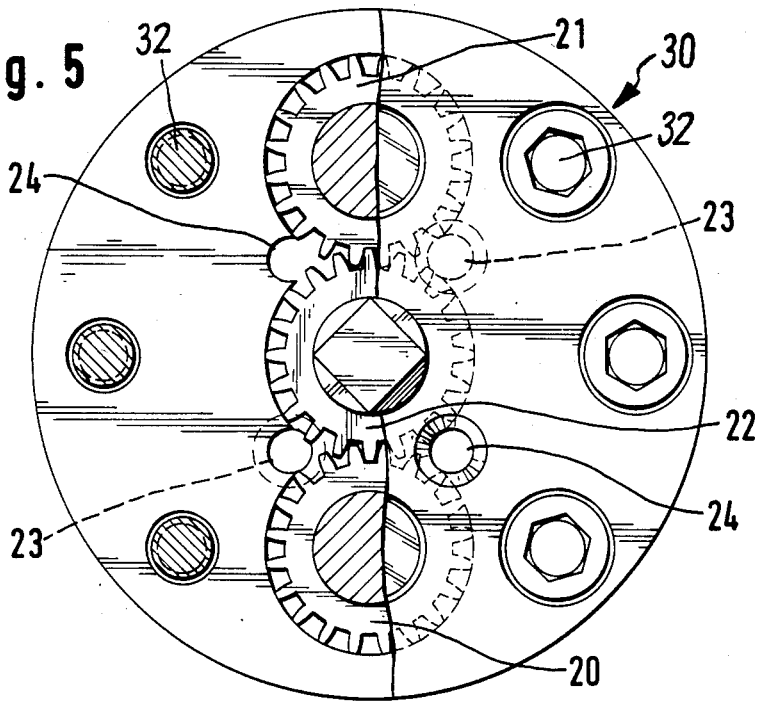
FIG. 5 shows a view of the detail "Z".

With the pump illustrated in FIGS. 3 to 5 the same principle is applied, but in this case gear pumps which are mounted in the actual shafts are used, in place of screws, to convey the lubricant through the shafts. These pumps themselves rotate with the shafts, and their driving pins 15 are secured in the end wall 8. These conveying means therefore consist of the gear 22, which is fixed to a pin 15 which in turn is fixed to the front side wall 8. The gears 20 and 21 rotate about the said gear 22. The housing 30 for the three gears 20, 21 and 22 is shown best in FIG. 5, and this housing is fixed by fasteners 32 to rotate with the gear shaft 3. Hence, as the gear shaft rotates the gears 20 and 21 rotate about the fixed gear 22. The lubricant passes from the delivery side 9 of the pump, through the channels 12, 13, 14 and 24, to the conveying means (gear pump) and, from there, flows back through the channels 16 or the bores 17 and 18 and 19, via the bearing bushes 4, to the delivery side 9 of the gear pump.

In these illustrated exemplary embodiments of the device according to the invention, the part-stream of the melt which is used for lubrication is taken from the delivery side of the gear pump and also conveyed back to the delivery side. However, it is also possible, within the scope of the invention, to take the part-stream of the conveyed medium, which is used for lubrication, from the suction side of the pump and to convey it back to the suction side or to convey the part-stream in the same direction as, or in the opposite direction to the main flow of melt between the suction side and the delivery side.

Accordingly, as shown in FIG. 1, the partial melt used for lubrication purposes may be withdrawn from either side of alternate channels 12*a* and returned via the other side of channels 12*a*. In this case, the channels 12*a* would replace the channels 12. Also, the intake for the lubricating melt may comprise either side of channels 12*a* and the return either side of channels 12. This arrangement may be reversed wherein the intake comprises either side of channels 12 and the return either side of channels 12*a*.

We claim:

1. A self-lubricating gear pump having at least several shafts with bearings for the shafts, a flow passageway extending through the pump from the inlet to the outlet thereof, lubrication means constructed and arranged to lubricate the bearings of the pump with the medium being conveyed by the pump, the lubrication means including delivery channels connecting the pump flow passageway with the bearings and separate discharge channels connecting the bearings to the flow passageway, and conveying means disposed between the delivery and discharge channels coaxially positioned in the shafts and movable relative thereto, the conveying means communicating with the delivery and discharge channels for causing a portion of the medium being conveyed by the pump to flow through the channels to lubricate the bearings.

2. A gear pump according to claim 1 wherein the delivery and discharge channels connect to the flow passageway on the delivery side of the pump.

3. A gear pump according to claim 1 wherein the delivery and discharge channels connect to the flow passageway on the suction side of the pump.

4. A gear pump according to claim 1 wherein the delivery channel connects to the flow passageway on the suction side of the pump and the discharge channel connects to the flow passageway on the delivery side of the pump.

5. A gear pump according to claim 1 wherein the conveying means comprises screw conveyors.

6. A gear pump according to claim 1 wherein the conveying means comprises gear pumps.

* * * * *